US009810413B2

(12) United States Patent
Buhl

(10) Patent No.: US 9,810,413 B2
(45) Date of Patent: Nov. 7, 2017

(54) TORCH WITH A ROTARY SWITCH

(71) Applicant: ZWEIBRÜDER OPTOELECTRONICS GMBH & CO. KG, Solingen (DE)

(72) Inventor: Erich Buhl, Solingen (DE)

(73) Assignee: ZWEIBRÜDER OPTOELECTRONICS GMBH & CO. KG, Solingen (DE)

( * ) Notice: Subject to any disclaimer, the term of this patent is extended or adjusted under 35 U.S.C. 154(b) by 118 days.

(21) Appl. No.: 14/441,240

(22) PCT Filed: Jan. 2, 2014

(86) PCT No.: PCT/DE2014/000002
§ 371 (c)(1),
(2) Date: May 7, 2015

(87) PCT Pub. No.: WO2014/106507
PCT Pub. Date: Jul. 10, 2014

(65) Prior Publication Data

US 2015/0300616 A1 Oct. 22, 2015

(30) Foreign Application Priority Data

Jan. 4, 2013 (DE) ..... 10 2013 000 153

(51) Int. Cl.
*F21L 4/00* (2006.01)
*F21V 23/04* (2006.01)
*F21Y 115/10* (2016.01)

(52) U.S. Cl.
CPC ..... *F21V 23/0428* (2013.01); *F21L 4/00* (2013.01); *F21L 4/005* (2013.01); *F21V 23/04* (2013.01);
(Continued)

(58) Field of Classification Search
None
See application file for complete search history.

(56) References Cited

U.S. PATENT DOCUMENTS 2,852,632 A 9/1958 Garland
4,581,686 A 4/1986 Nelson
(Continued)

FOREIGN PATENT DOCUMENTS

DE 10 2010 026 918 A1 1/2012
WO 2012/006977 A2 1/2012

*Primary Examiner* — Andrew Coughlin
*Assistant Examiner* — Eric T Eide
(74) *Attorney, Agent, or Firm* — McGlew and Tuttle, P.C.

(57) ABSTRACT

A torch (flashlight) and a method for producing a torch housing and a torch head provides a torch which is of simple design and is robust. The torch has a rotary switch, in which torch clear classification of the selected function is possible, so that regular function monitoring can be dispensed with. The torch housing and the torch head can be connected in a captive manner and so as to be rotated in relation to one another to form a rotary switch having different switching states. Markings are arranged on the housing and on the lamp head. The markings allowing clear classification of the switching states. After the torch is first assembled and after the torch is first switched on, to clearly define the switching states by in each case a torch-head-side and a housing-side marking for subsequent switch-on processes.

18 Claims, 3 Drawing Sheets

(52) U.S. Cl.
CPC ..... *F21V 23/0414* (2013.01); *F21Y 2115/10* (2016.08)

(56) References Cited

U.S. PATENT DOCUMENTS

| | | | | |
|---|---|---|---|---|
| 4,782,432 | A | 11/1988 | Coffman | |
| 7,722,209 | B2 | 5/2010 | Matthews et al. | |
| 2004/0105258 | A1* | 6/2004 | Galli | F21L 4/027 362/205 |
| 2005/0099805 | A1* | 5/2005 | Chapman | F21L 4/027 362/184 |
| 2006/0039139 | A1* | 2/2006 | Maglica | F21L 4/027 362/202 |
| 2008/0247158 | A1 | 10/2008 | Halasz et al. | |
| 2010/0033963 | A1* | 2/2010 | Maglica | F21L 4/005 362/208 |
| 2010/0091485 | A1 | 4/2010 | Matthews et al. | |
| 2010/0277295 | A1 | 11/2010 | Matthews et al. | |
| 2011/0122609 | A1* | 5/2011 | Dahlin | F21L 4/027 362/184 |
| 2011/0204818 | A1 | 8/2011 | Spartano | |
| 2011/0227500 | A1 | 9/2011 | West | |
| 2012/0068624 | A1 | 3/2012 | Matthews et al. | |

* cited by examiner

TORCH WITH A ROTARY SWITCH

CROSS REFERENCE TO RELATED APPLICATIONS

This application is a United States National Phase Application of International Application PCT/DE2014/000002 filed Jan. 2, 2014 and claims the benefit of priority under 35 U.S.C. §119 of German Patent Application DE 10 2013 000 153.6 filed Jan. 4, 2013, the entire contents of which are incorporated herein by reference.

FIELD OF THE INVENTION

The present invention relates to a torch (also known as a flashlight) comprising a torch housing and a torch head. The invention also relates to a method for producing a torch of this kind.

BACKGROUND OF THE INVENTION

Torches in different forms and for different applications have been known for several decades, with cylindrical torches of the kind mentioned in the introductory part having proven particularly preferred on account of the simple configuration, the ability to produce them in a cost-effective manner and the given stability. In addition to the shape, the possible functions of torches for different occupation groups have also expanded, these making different demands of the torches. In occupation groups such as for emergency services including the police and the fire brigade and in particular for railway conductors for example, torches which emit light in different colors in order to be able to communicate with colleagues by selecting the color are desirable.

For these reasons, torches which have LEDs of different colors and which can be switched on by means of a rotary switch are known in accordance with the prior art.

U.S. Pat. No. 7,722,209 B2 discloses, for example, a torch which has a rotary ring in the immediate vicinity of the torch head, the said rotary ring having magnets arranged in it and these magnets interacting with Hall probes which are arranged within the torch. Different LEDs and consequently different colors and/or intensities are activated depending on the set angular position.

A configuration of a rotary switch of this kind is highly complex and expensive to produce on account of the complicated components. In addition, these rotary switches are rapidly damaged in the event of robust use, and therefore problem-free functioning over a long period of time is not guaranteed.

An alternative and, in the process, robust and simple variant of a rotary switch is directly realized in the case of cylindrical torches by rotating the torch head or the end cap which are generally connected to the torch housing in a rotatable manner by means of a thread in any case. In the case of pressure switches of this kind, a contact element passes over different contact zones during rotation, this resulting in different electrical resistances or different LEDs being incorporated in the electrical circuit. One example of a rotary switch of this kind is disclosed by WO 2012/006977, according to which the rotary switch is formed by a rotatable ring on the end cap.

However, an embodiment of this kind has the disadvantage that the relative position of the contact elements which are arranged such that they can rotate in relation to one another is unclear as soon as the torch is unscrewed—for example in order to replace the batteries. When assembled, a clear angular position is no longer provided since threaded connections can be screwed together in different angular positions in relation to one another. As a result, the torch has to be switched on before each use in order to check whether the lamp lights up with the intended and set function. If a functional test of this kind is accidentally not carried out, misunderstandings or even severe accidents can be caused—depending on the field of application—since there is a big difference, for example, between a conductor transmitting a red signal or a green signal to the driver of his train.

SUMMARY OF THE INVENTION

Since carrying out a functional check on the torch before each use is precluded during busy train operation, and when used by the police or fire department, the object of the present invention is to provide a torch which is of simple design and is robust and has a rotary switch, in which torch clear classification of the selected function is possible, so that regular function monitoring can be dispensed with.

According to the invention, the torch housing and the torch head can be connected to one another in a captive manner and such that they can be rotated in relation to one another in order to form a rotary switch having different switching states, wherein markings are arranged on the housing and on the lamp head, the said markings allowing clear classification of the switching states. In line with the method according to the invention, for clear classification of the switching states, after the torch is first assembled—that is to say is assembled at the factory—and after the said torch is first switched on, the switching states are clearly defined by in each case a torch-head-side and a housingside marking for subsequent switch-on processes.

Since the torch head and the torch housing are connected to one another in a captive manner and no longer have to be separated from one another in order to replace the batteries, the relative angular position between the torch housing and the torch head, which ultimately form the rotary switch, is maintained. Accordingly, unintentional adjustment of the defined relative position and consequently adjustment of the switching states is precluded. In this respect, it is possible to reliably set the function—such as the color or intensity for example—in which the torch is intended to light up before the torch is switched on. Misunderstandings between workers who communicate with one another by means of such signals are precluded as a result.

Preferred embodiments of the present invention will be specified in the text which follows and in the dependent claims.

According to a first preferred embodiment of the invention, at least one of the markings is arranged on an annular element which is connected in a rotationally fixed manner to the preferably cylindrical torch housing or to the preferably cylindrical torch head. According to a preferred embodiment of the method, the annular element is in this case connected in a rotationally fixed manner to the torch housing or to the torch head after the said torch is first switched on. As an alternative to an embodiment comprising an annular element, it is also possible to solder, to adhesively bond or to attach the markings in some other way directly onto the torch head or the torch housing after the torch is assembled. According to a further preferred embodiment of the present invention, provision is made for an annular contact spring to be rotatably mounted between the torch head and the torch housing, the said contact spring making contact with a housing-side, annular, electrical contact area by way of a first partial section and there latching into predetermined positions, and passing over electrical contact zones of a plate by way of a second partial section. The plate is preferably connected in a rotationally fixed manner and at least indirectly to the torch housing, wherein, according to a particularly preferred refinement, the plate is connected to an annular sleeve which can be inserted into the torch housing on the torch-head side and on which the electrical contact area and a plurality of groove-like recesses which are spaced apart from one another are arranged on the torch-head side. The contact spring latches into these groove-like recesses, as a result of which rotation of the contact spring and therefore adjustment of the switching states is possible only against the axially acting force of the spring.

In addition to the groove-like slots and the annular contact area, according to a preferred embodiment of the invention, the annular sleeve is spaced apart from the torch housing in the radial direction in regions, as a result of which the annular sleeve forms a rear annular stop face. This stop face is part of the captive mounting of the torch head. To this end, the torch head specifically preferably has a front part and a rear part, wherein a reflector or a lens is held by a fixing sleeve in the front part. In contrast, the rear part preferably has an annular stop face which, in the assembled state, bears against the stop face of the annular sleeve in order to form a captive connection between the torch head and the torch housing.

In order that the contact spring is rotated by a rotary movement of the torch head which is held in a captive manner, according to a preferred embodiment of the invention, the fixing sleeve has at least one recess, a driver of the annular contact spring engaging into the said recess. As an alternative to this, the driver can also project into a recess in the lamp head.

Overall, the preferred refinements in particular provide a simple, robust and consequently low-cost way of creating a rotary switch which allows clear classification of the switching states over the long term. In this case, the essential components of the rotary switch are the torch head which is held in a rotatable yet captive manner, the contact spring which is at least indirectly connected to the torch head, and the contact plate which is connected in a rotationally fixed manner in the torch housing or an annular sleeve which is connected to the said torch housing. The classification of the switching states is defined by markings on the annular element and the torch head. Consequently, complicated and expensive arrangement of Hall probes and the like can be dispensed with.

A specific embodiment of the present invention will be explained below with reference to the figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which an embodiment of the invention are illustrated.

DESCRIPTION OF THE PREFERRED EMBODIMENTS

Figure 1A:
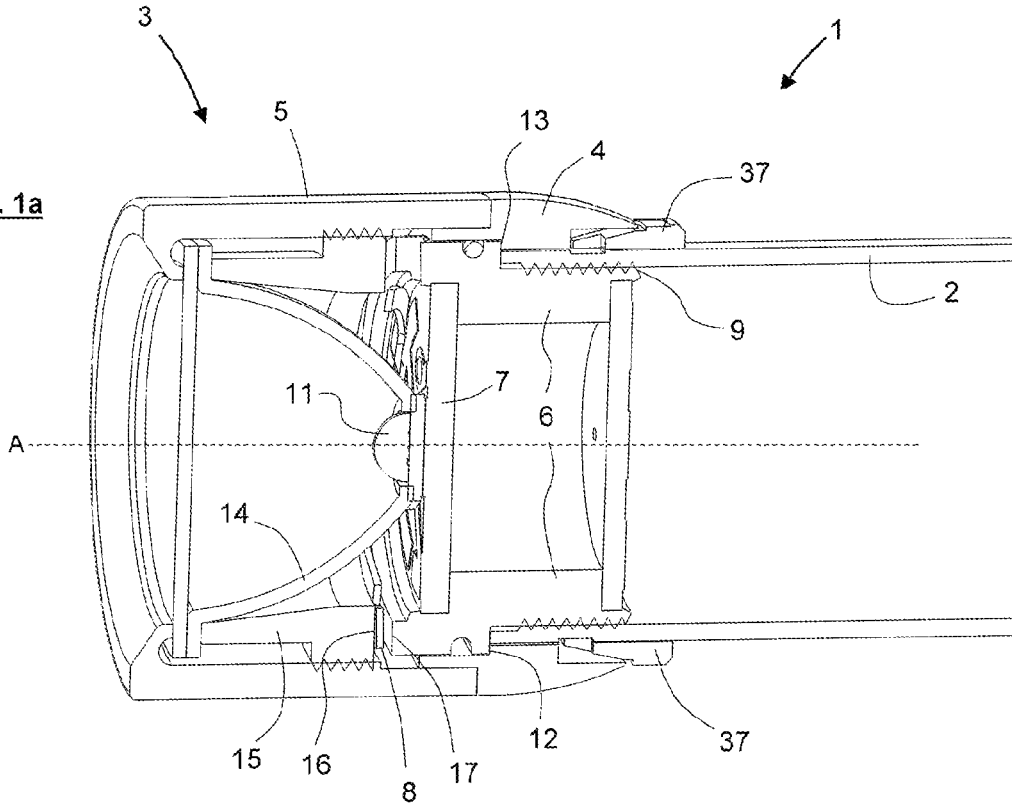
FIG. 1*a* is a cross-sectional view through an assembled torch.
Figure 1B:
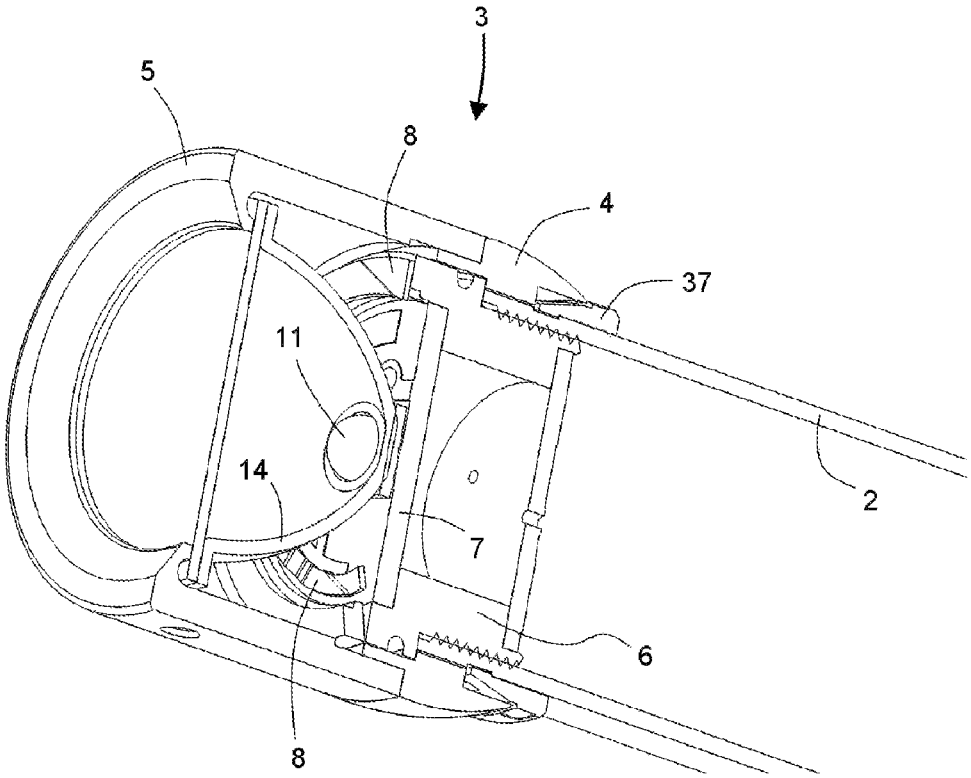
FIG. 1*b* is a perspective cross-sectional view through an assembled torch.

A specific embodiment of a torch 1 according to the invention essentially comprises a torch housing 2, a torch head 3 which is mounted such that it can be rotated in relation to the said torch housing about the longitudinal axis A and is held in a captive manner and has a rear part 4 and a front part 5, an annular sleeve 6, a contact plate 7 and a contact spring 8. The annular sleeve 6 is connected to the torch housing 2 by means of a threaded section 9. As an alternative to this, the annular sleeve 6 could also be adhesively bonded, pressed or connected in some other releasable or permanent manner to the torch housing 2. At that end which is averted from the torch housing 2, the annular sleeve 6 is connected to the contact plate 7 in a rotationally fixed manner, electrical contact zones 10, 10', 10", 10'" (see FIG. 3*b*) being formed on the said contact plate. Furthermore, a light source in the form of an LED 11 is located on the contact plate 7. The annular sleeve 6 protrudes beyond the torch housing 2 in the radial direction, with the result that a rear annular stop face 12 is formed on the annular sleeve 6. In the assembled state, this stop face 12 is in contact with a corresponding bearing face 13 of the rear part 4 of the torch head 3, as a result of which the torch head 3 is connected to the torch housing 2 in a captive manner but such that it can rotate about the longitudinal axis A.

Figure 2:
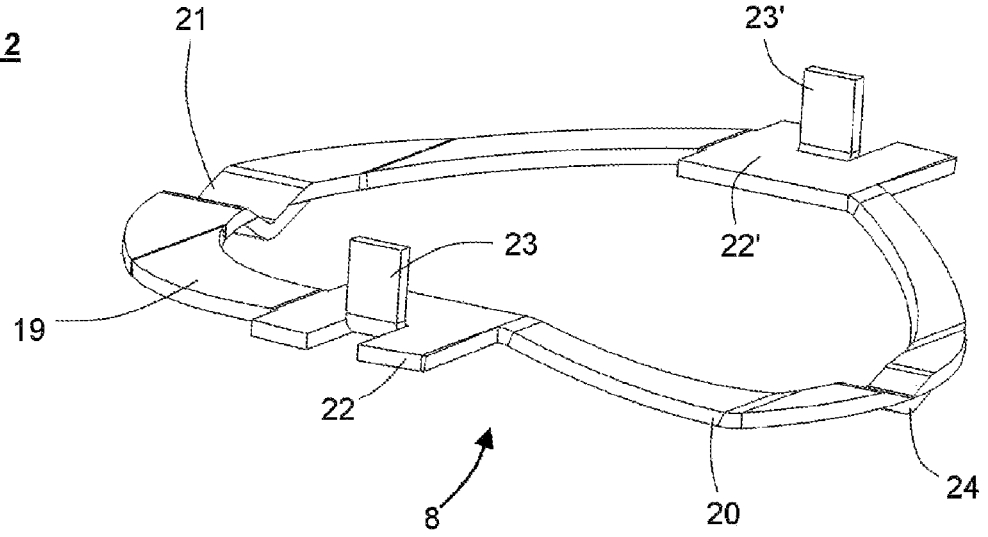
FIG. 2 is a perspective view of a contact spring.

The front part 5 of the torch head 3 has a reflector 14 which is held in an interlocking manner by a fixing sleeve 15 in the front part 5. To this end, the fixing sleeve 15 is screwed into the front part 5 by means of corresponding threaded sections. In the assembled state, the rear end face 16 of the fixing sleeve 15 is axially spaced apart from the end face 17 of the annular sleeve 6 to a certain extent. A contact spring 8 is arranged in-between said end faces, the design of said contact spring being illustrated in detail in FIG. 2.

The contact spring 8 is substantially annular, wherein it has two partial circle sections 19, 20 which extend over 180° and have different radii. In the assembled state, the first partial circle section 19 lies on the electrical contact area 31 (see FIGS. 3*a, b*) of the annular sleeve 6. Furthermore, a v-shaped latching lug 21 is formed in the first partial section 19, the said latching lug latching into recesses 32 (see FIGS. 3*a, b*).

The first and the second partial section 19, 20 are connected to one another by a connecting piece 22, 22', a driver 23, 23' lifting off from each of the said connecting pieces. In the assembled state, these drivers 23, 23' engage in (not illustrated) recesses in the fixing sleeve 15, so that the contact spring 8 rotates due to rotation of the torch head 3.

The second partial circle section 20 of the contact spring 8 is arranged at an angle in relation to the first partial circle section 19 and has an electrical contact element 24 in the form of a v-shaped slot. The manner of operation of this contact element is shown, in particular, by FIG. 3*a*.

Figure 3A:
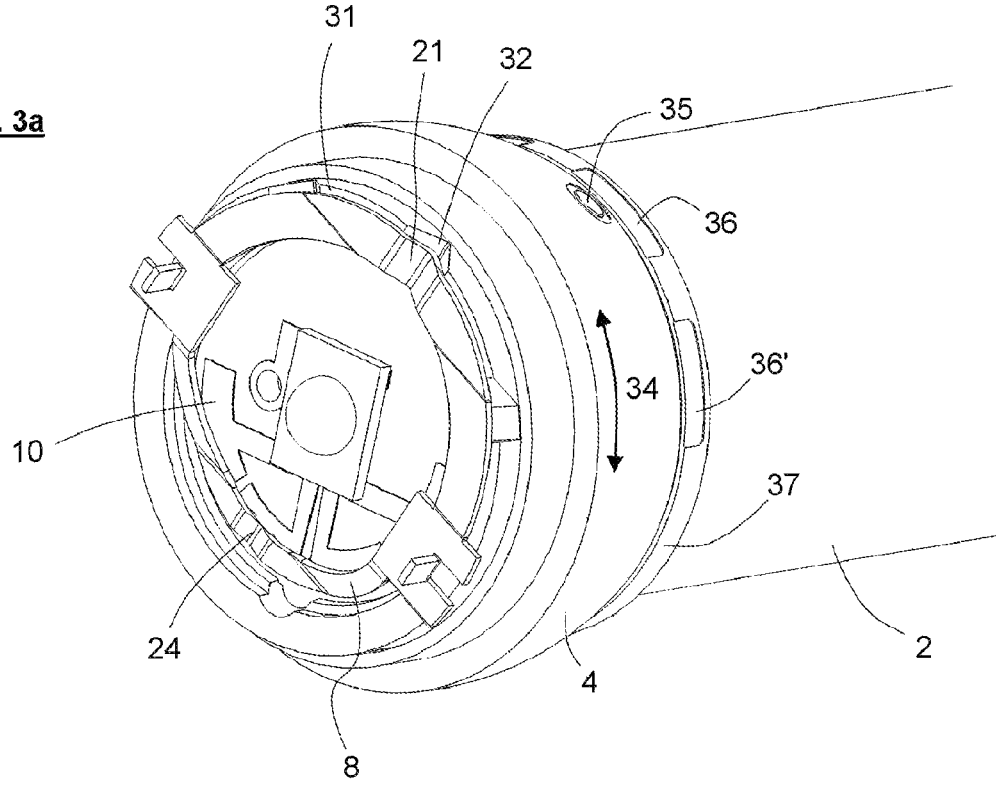
FIG. 3*a* is a perspective illustrations of a torch without the front part of the torch head.
Figure 3B:
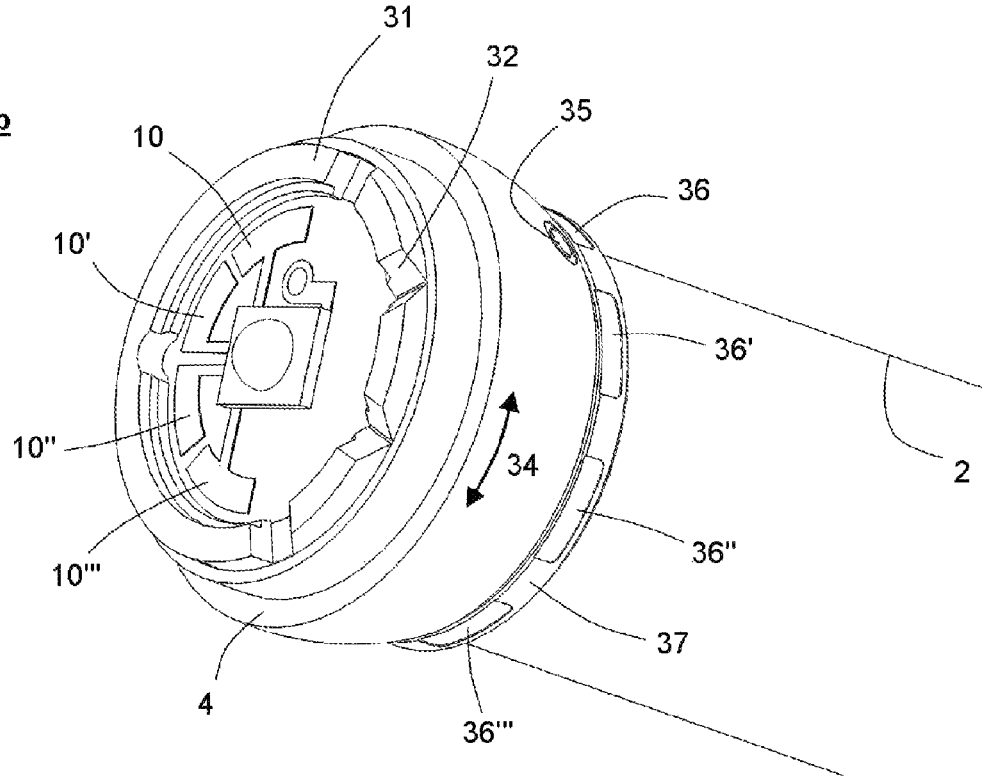
FIG. 3*b* is another perspective illustrations of a torch without the front part of the torch head

FIG. 3*a* shows a torch 1 in a perspective view and without the front part 5 of the torch head 3. The contact spring 8 rests on the electrical contact area 31 of the annular sleeve 6 and latches into recesses 32 there. The annular sleeve 6 is connected to the contact plate 7 in a rotationally fixed manner, different contact zones 10, 10', 10", 10'" being formed on the said contact plate. Depending on its angular position, the contact spring 8 passes over the contact zones 10, 10', 10", 10'" by way of the v-shaped contact element 24 and consequently switches different electrical states. The number of possible switching states is unlimited in principle, wherein four different contact zones 10, 10', 10", 10'" and therefore four different switching states are provided in the illustrated exemplary embodiment.

In order to adjust the switching states, the torch head 3 and therefore the front part 5 and the rear part 4 are rotated in arrow direction 34, as a result of which the contact spring 8 is likewise rotated. In order for the user to be able to select the desired switching state before the torch is turned on, a marking 35 is arranged on the rear part 4 of the torch head 3. Furthermore, a plurality of markings 36, 36' are applied on an annular element 37 which is connected in a rotationally fixed manner to the torch housing 2 only after the said torch is first turned on. As a result, the set classification of the switching states is also maintained when a battery is changed, it generally being necessary to remove only the end cap for this purpose. In order to be turned on, the torch preferably has a (not illustrated) pressure switch in the end cap (end cap switch) or on the torch housing.

While specific embodiments of the invention have been shown and described in detail to illustrate the application of the principles of the invention, it will be understood that the invention may be embodied otherwise without departing from such principles.

The invention claimed is:

1. A flashlight comprising:

a flashlight housing;

a flashlight head connected to the flashlight housing in a captive manner and such the flashlight head can be rotated in relation to the flashlight housing to form a rotary switch having different switching states;

a plurality of markings arranged on the housing and on the lamp head, the markings allowing unambiguous classification of the switching states;

a plate and an annular ring-shaped contact spring rotatably mounted between the flashlight head and the flashlight housing, wherein the annular contact spring is movable relative to the plate, the contact spring making contact with a housing-side, annular, electrical contact area by way of a first partial section and there latching into predetermined positions and passing over electrical contact zones of the plate by way of a second partial section, the annular ring-shaped contact spring having a single annular course.

2. A flashlight according to claim 1, wherein an annular element is connected in a rotationally fixed manner to one of the flashlight housing and the flashlight head and at least one of the housing and the lamp head markings is arranged on the annular element.

3. A flashlight according to claim 1, wherein the plate is connected in a rotationally fixed manner and at least indirectly to the flashlight housing.

4. A flashlight according to claim 1, wherein the plate is connected to an annular sleeve inserted into the flashlight housing on a flashlight-head side and on which the electrical contact area and a plurality of groove-like recesses which are spaced apart from one another are arranged on the flashlight-head side.

5. A flashlight according to claim 4, wherein the annular sleeve is spaced apart from the flashlight housing in the radial direction in regions and forms a rear annular stop face.

6. A flashlight according to claim 1, wherein the flashlight head has a front part and a rear part, wherein a reflector is held in an interlocking manner by a fixing sleeve in the front part.

7. A flashlight according to claim 6, wherein the rear part has an annular stop face which bears against a stop face of the annular sleeve in order to form a captive connection between the flashlight head and the flashlight housing.

8. A flashlight according to claim 6, wherein the fixing sleeve has at least one recess at the rear, a driver of the annular contact spring engaging into the recess, so that the contact spring can be rotated by means of a rotary movement of the flashlight head.

9. A flashlight according to claim 1, wherein the plate comprises a plurality of recesses, the plurality of recesses defining the predetermined positions, the annular contact spring comprising an electrical contact projection, at least a portion of the annular contact projection being arranged in one of the plurality of recesses.

10. A flashlight according to claim 1, wherein the annular ring-shaped contact spring comprises a first protrusion and a second protrusion, the first protrusion being located at a spaced location from the second protrusion in a circumferential direction of the annular contact spring.

11. A method for producing a flashlight comprising:

providing a flashlight housing and a flashlight head which can be connected to one another such that they can be rotated and in a captive manner in order to form a rotary switch having different and selectable switching states;

providing unambiguous classification of the switching states, after the flashlight is first assembled and after said flashlight is first switched on, to clearly define the switching states by in each case a flashlight-head-side and a housing-side marking for subsequent switch-on processes;

providing a plate and an annular ring-shaped contact spring rotatably mounted between the flashlight head and the flashlight housing, wherein the ring-shaped annular contact spring is movable relative to the plate, the contact spring making contact with a housing-side, annular, electrical contact area via a first partial section and the contact spring latching into predetermined positions and passing over electrical contact zones of the plate by way of a second partial section, the annular ring-shaped contact spring extending along a single annular course.

12. A method according to claim 11, wherein the housing-side or the flashlight-side marking is arranged on an annular element which, after the flashlight is first switched on, is connected in a rotationally fixed manner to the flashlight housing or to the flashlight head.

13. A method according to claim 11, further comprising:

providing a fixing sleeve;

providing an annular sleeve comprising an annular sleeve stop face, wherein the flashlight head has a rear part, the rear part having an annular stop face which bears against the annular sleeve stop face in order to form a captive connection between the flashlight head and the flashlight housing.

14. A flashlight according to claim 13, wherein the fixing sleeve has at least one recess, the annular contact spring comprising a driver, the driver engaging into the at least one recess, so that the contact spring can be rotated by means of a rotary movement of the flashlight head.

15. A method according to claim 11, wherein the annular contact spring comprises at least one annular contact spring electrical contact element, the plate comprising at least a plurality of plate recesses, wherein the least one annular contact spring electrical contact element is movable from one of the plurality of plate recesses to another one of the plurality of plate recesses via rotating the flashlight head.

16. A method according to claim 11, wherein the plate comprises a plurality of recesses, the plurality of recesses defining the predetermined positions, the annular contact spring comprising at least one electrical contact projection, at least a portion of the at least one annular contact projection being arranged in one of the plurality of recesses.

17. A method according to claim 11, wherein the plate comprises a plurality of recesses, the plurality of recesses defining the predetermined positions, the first partial section comprising at least one electrical contact projection, at least a portion of the at least one electrical contact projection being arranged in one of the plurality of recesses.

18. A method according to claim 11, wherein the annular contact spring comprises a first protrusion and a second protrusion, the first protrusion being located at a spaced location from the second protrusion in a circumferential direction of the annular contact spring, the plate comprising at least a plurality of plate recesses, wherein each of the first protrusion and the second protrusion is movable from one of the plurality of plate recesses to another one of the plurality of plate recesses via rotating the flashlight head.

* * * * *